United States Patent [19]

Bakker et al.

[11] 4,281,453

[45] Aug. 4, 1981

[54] SHAVING APPARATUS

[75] Inventors: Eppe Bakker; Ebbe Boiten; Eildert Kingma; Gerard J. Lenting; Willem S. Wijma, all of Drachten, Netherlands

[73] Assignee: U.S. Philips Corporation, New York, N.Y.

[21] Appl. No.: 75,471

[22] Filed: Sep. 14, 1979

[30] Foreign Application Priority Data

Sep. 18, 1978 [NL] Netherlands ..... 7809461

[51] Int. Cl.[3] ..... B26B 19/14

[52] U.S. Cl. ..... 30/43.6; 30/346.51

[58] Field of Search ..... 30/34.2, 50, 43.4–43.6, 30/43.92, 346.51

[56] References Cited

U.S. PATENT DOCUMENTS

| | | | |
|---|---|---|---|
| 2,288,162 | 6/1942 | Hulst | 30/34.2 |
| 2,335,547 | 11/1943 | Smith | 30/50 |
| 2,817,146 | 12/1957 | Roberts | 30/50 X |
| 3,088,205 | 5/1963 | Ellis | 30/34.2 |
| 3,962,784 | 6/1976 | Tietjens | 30/43.6 |
| 4,044,463 | 8/1977 | Tietjens | 30/34.2 |
| 4,151,645 | 5/1979 | Tietjens | 30/43.6 |

*Primary Examiner*—Gary L. Smith

*Attorney, Agent, or Firm*—Thomas A. Briody; William J. Streeter; Rolf E. Schneider

[57] ABSTRACT

The disclosure relates to a shaving apparatus having a shear plate with hair entry apertures and a drivable cutting unit with at least one cutting element provided with a cutting edge. Owing to the presence of the shear plate a shaving apparatus of this type does not allow the hairs to be shaved as closely to the skin as a shaving apparatus without such a shear plate, where the cutting element is in direct contact with the skin. In order to eliminate this drawback a construction is proposed in which the cutting element is provided with a hair pulling element which leads in the direction of the driving and which is immobile relative to the cutting element.

9 Claims, 19 Drawing Figures

SHAVING APPARATUS

This invention relates to a shaving apparatus having a shear plate with hair entry apertures and a drivable cutting unit with at least one cutting element provided with a cutting edge.

Such a shaving apparatus is for example known from U.S. Pat. No. 3,913,225. As a result of the presence of the shear plate a shaving apparatus of this type does not allow the hairs to be shaved as closely to the skin as a shaving apparatus without such a shear plate, where the cutting element is in direct contact with the skin.

It is the object of the present invention to eliminate this drawback by simple means and this results in a construction which is characterized in that the cutting element is provided with a hair-pulling element which leads in the direction of driving and which is immobile or immovable relative to the cutting element.

A special embodiment is characterized in that the hair-pulling element is provided with a contact edge for the hair, which contact edge is situated at a greater distance from the shear plate than the cutting edge of the cutting element.

In the case of a cutting unit with a plurality of cutting elements the embodiment is preferably such that the hair-pulling elements are combined with a central body to form a separate component.

A further embodiment is characterized in that the hair-pulling element is provided with teeth.

A special embodiment thereof is characterized in that the teeth are disposed at an acute angle relative to the shear plate and are provided with contact edges on both sides. Preferably, the construction is then such that the gap between two adjacent teeth has a widened portion near the base of the teeth.

Yet another embodiment of a shaving apparatus of the instant type, in which during cutting of a hair the cutting edge of a cutting element cooperates with the elongate edge of a hair-entry aperture is characterized in that the contact edge of the hair pulling element takes the form of a sharp edge and the projection of this sharp edge on the shear plate makes an acute angle with the elongate edge of the hair-entry aperture, which acute angle is greater than the friction angle, and the sharp edge of the hair-pulling element tapers away from the shear plate from a point of the sharp edge, which leads in the direction of driving towards a point of the sharp edge which trails in the direction of driving An elaboration of such embodiment is characterized in that the magnitude of the angle between the projection of the sharp edge of the hair-pulling element and the edge of the hair entry aperture varies continuously.

In general a cutting element may also be provided with a plurality of hair-pulling elements as described above.

The invention is also embodied by a cutting unit as used in any shaving apparatus as described above.

The invention will now be explained with reference to the accompanying drawings, in which.

Figure 1:
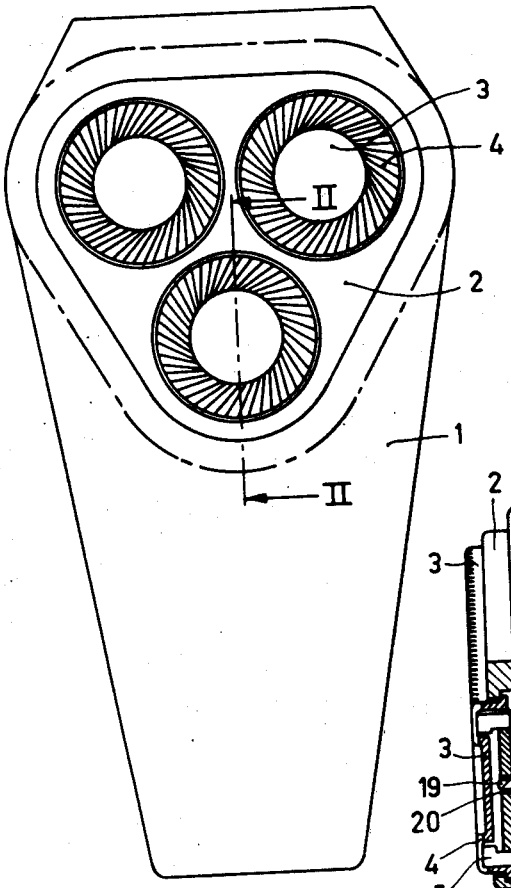
FIG. 1 is an elevation of a shaving apparatus having three shear plates.
Figure 2:
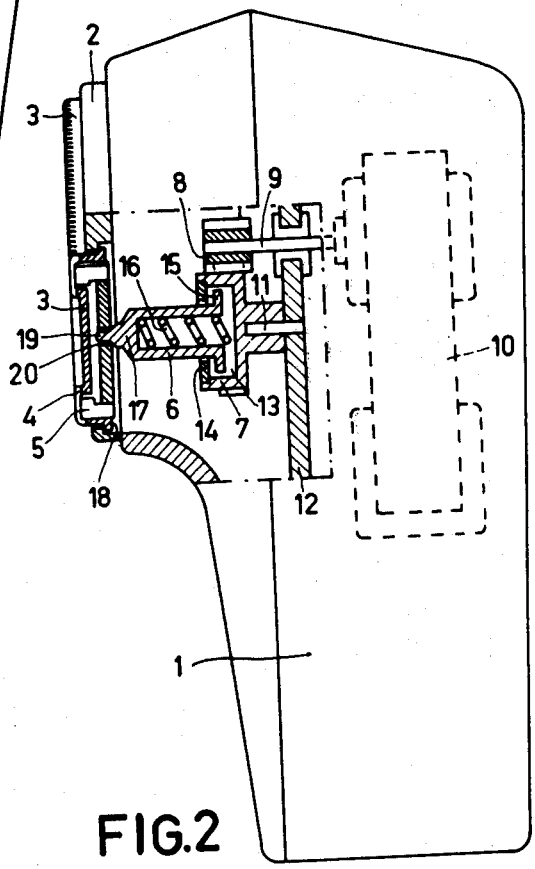
FIG. 2 shows the shaving apparatus of FIG. 1 in side view and partly in a cross-section taken on the line II—II in FIG. 1.

The shaving apparatus of FIGS. 1 and 2 comprises a housing 1, of which a part takes the form of a shear-plate holder 2 for three shear plates 3. The shear plates 3 are formed with hair-entry apertures 4.

As shown in the partial cross-section of FIG. 2, a cutting unit 5 is situated on the inner side of a shear plate 3. This cutting unit 5, which for the sake of clarity is shown only schematically in FIG. 2, is shown in perspective and on an enlarged scale in FIG. 3.

By means of the hollow spindle 6 (FIG. 2) the gear wheels 7 and 8, and the spindle 9 the cutting unit 5 is coupled to the electric motor 10, so that the cutting unit is rotatable relative to the associated shear plate 3. The gear wheel 7 is rotatably journalled on a pin 11, which is mounted in a mounting plate 12. The gear wheel 7 has a recess 13 which is closed by a cover plate 14. This recess accommodates the flange 15 formed on the end of the hollow spindle 6. By giving the flange 15 a non-round, for example square, shape and by accordingly shaping the recess 13 a coupling is obtained for transmitting the rotary movement from the gear wheel 7 to the spindle 6, the spindle being pivotal in all directions. The spring 16, which for its greater part is situated in the hollow spindle 6 and which is tensioned between the hollow spindle 6 and the gear wheel 7, exerts a force on the spindle 6 in the direction of the cutting unit 5. As the cylindrical portion 17 of the spindle 6 engages with the cutting unit 5, this force is exerted on the cutting unit and via the cutting unit on the shear plate 3, so that the shear plate is urged against the shear plate holder 2 by means of the rim 18. As a result of external forces as may occur during use of the shaving apparatus, the shear plate 3 together with the cutting unit 5 and the spindle 6 can be pressed inwards against the action of the spring 16.

The coupling for the transmission of the rotary movement between the spindle 6 and the cutting unit 5 is obtained in that the spindle 6 is provided with an end 19 of substantially rectangular cross-section. This end 19 is situated in a corresponding coupling aperture 20 of the cutting member 5.

The coupling to the electric motor 10 described in the foregoing is identical for the three cutting units of the shaving apparatus of FIGS. 1 and 2, the three gear wheels 7 being in engagement with a single centrally disposed gear wheel 8 on the motor spindle 9.

The cutting unit 5 (FIG. 3) is essentially constituted by a central disc 21 provided with the coupling aperture 20 and, at its circumference, with the cutting elements 22 which are connected to the central disc 21 by means of the arms 23.

The cutting elements 22 are provided with cutting edges 24. The hair-pulling element 25 is constituted by a projecting portion of a cutting element, which leads in the direction of driving P and which is provided with a contact edge 26.

This contact edge 26 is a sharp edge and is situated at a greater distance from the shear plate 3 than the cutting edge 24.

Figure 4:
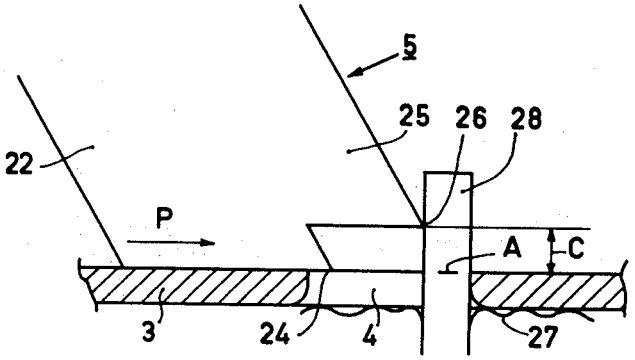
FIGS. 4 and 5 show details of the embodiment of FIG. 3.
Figure 5:
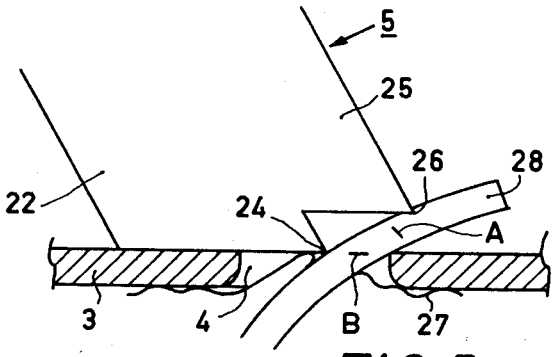

The operation of the cutting unit with such hair-pulling elements will now be explained with reference to FIGS. 4 and 5, which schematically show a side view of a part of the cutting unit 5 and a part of the shear plate 3, whilst moreover a skin portion 27 with a hair 28 is shown. The hair 28 is caught in an aperture 4 and as a result of the rotary movement of the cutting unit 5 it will soon come into contact with the sharp edge of a hair-pulling element (FIG. 4). The sharp edge 26 will penetrate the hair 28, so that the hair is moved along in the direction P by the hair-pulling element 25 and is pulled out of the skin over some length. In the situation of FIG. 5 the cutting edge 24 of the cutting element 22 has reached the hair 28 and the hair will be cut by cooperation of the cutting element and the shear plate 3. Without the hair pulling element 25 the hair would be cut at the location A (FIG. 4), but as a result of the action of this element 25 the hair is cut at the location B (FIG. 5) which is situated nearer the skin 27, yielding a better shaving result.

As upon contact by the sharp edge 26 the hair 28 can still bend into the oblique position as shown in FIG. 5, the sharp edge will generally slightly penetrate the hair, but will not cut the hair. In order to enable the hair 28 to deflect without the cutting unit 5 being lifted off the shear plate 3, the distance C between the sharp edge 26 and the shear plate 3 should be substantially equal to the average thickness of a hair, i.e. of the order of magnitude of 0.13 mm. The sharp edge 26 is consequently situated at a greater distance from the shear plate than the cutting edge 24.

In the embodiment just described the contact edge 26 is a sharp edge of approximately the same sharpness as the cutting edge 24. The contact edge 26 may alternatively have a more rounded shape, the hair being moved along by the friction between the hair-pulling element 25 and the hair 28.

Figure 3:
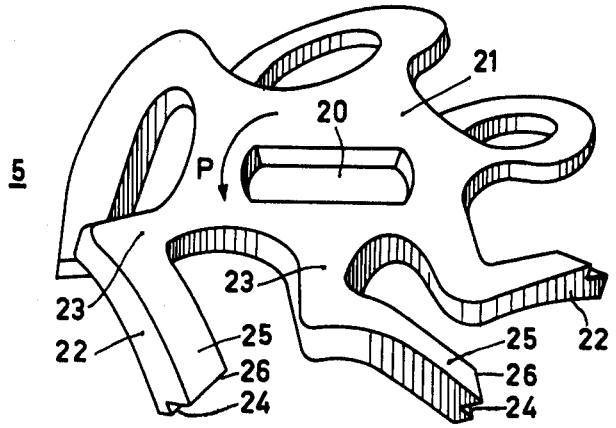
FIG. 3 is a perspective view on an enlarged scale of the cutting unit.
Figure 6:
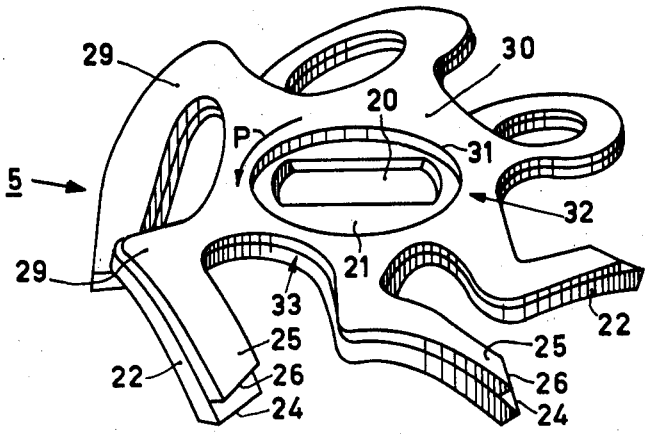
FIGS. 6 and 7 are perspective views on an enlarged scale of other embodiments of the cutting unit.

A variant of the embodiment of FIG. 3 is shown in FIG. 6. The hair-pulling elements 25 are now situated at the ends of arms 29, which are integral with a central body 30. In the central body the aperture 31 is formed. The hair-pulling elements 25, the arms 29 and the central body 30 are thus combined to form a separate component 32, the so-called hair-pulling member, which can simply be manufactured from a sheet material. The cutting elements 22 and the central disc 21 are also combined to form a cutting member 33.

The hair-pulling member 32 may for example be secured to the cutting member 33 by spot-welding or glueing.

The operation of the cutting unit of FIG. 6 is identical to that of FIG. 3.

Figure 7:
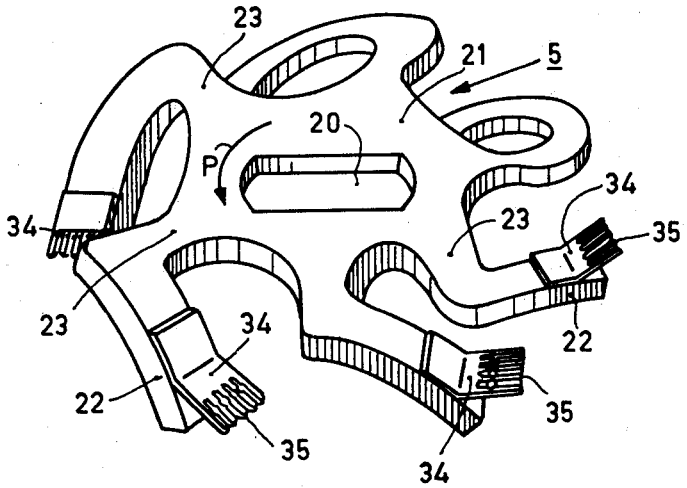

The embodiment of FIG. 7 also concerns a cutting unit 5 having a central disc 21 provided with the coupling aperture 20 and the cutting elements 22, which elements are secured to the central disc 21 with the aid of the arms 23.

On the cutting elements 22 hair-pulling elements 34 are formed which are provided with teeth 35.

Figure 8:
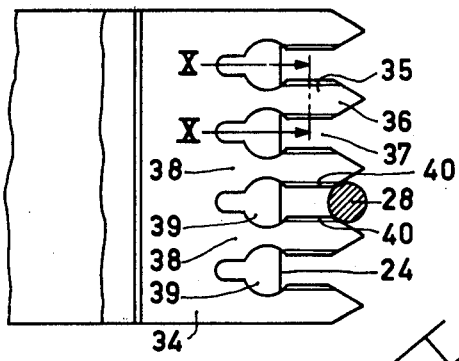
FIGS. 8 to 12 show details on a further enlarged scale of the embodiment of FIG. 7, with FIG. 10 being a still further enlarged view taken on the line X—X in FIG. 8.
Figure 10:
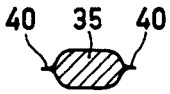
Figure 9:
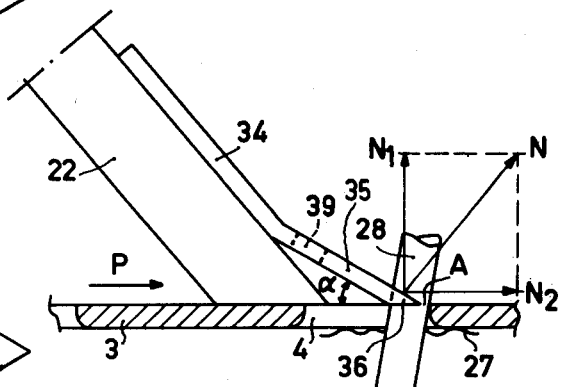
Figure 11:
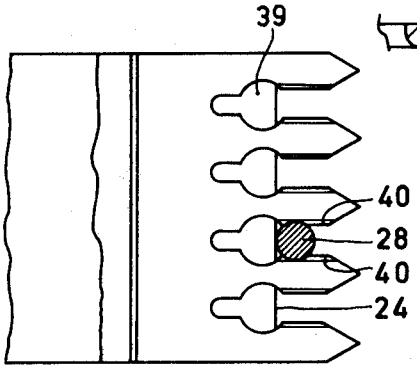
Figure 12:
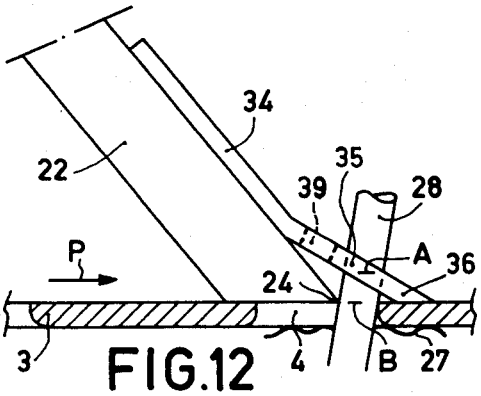

The operation of the embodiment of FIG. 7 will now be described with reference to FIGS. 8 to 12. FIGS. 9 and 12 schematically show a side view of a part of the cutting unit and the shear plate 3, whilst moreover a part of the skin 27 to be shaved with a hair 28 is shown. FIGS. 8 and 11 are plan views of the details in accordance with FIGS. 9 and 12 respectively. FIG. 10 is a cross-section of a tooth 35 taken on the line X—X in FIG. 8.

The teeth 35 are disposed at an acute angle $\alpha$ (FIG. 9) relative to the shear plate and are pointed at the ends 36, which increases the likelihood of a hair being caught between the teeth. The gaps 37 between two adjacent teeth each have a widened portion 39 near the base 38 of the teeth. The hair-pulling elements 34, including the teeth 35, take the form of plate-shaped parts which are secured to the cutting elements 22 by spot-welding or glueing. The hair-pulling elements may also be combined with a central body to form a separate hair-pulling member.

The teeth 35 are provided with contact edges 40 on both sides (FIG. 10).

When a hair 28 is caught between the ends 36 of two adjacent teeth, the edges 40 will penetrate the hair on both sides at a location A (FIG. 9). When frictional forces are neglected, the teeth 35 will generally exert a force N on the hair 28. During the movement of the teeth in the direction of driving P the component $N_1$ of this force will cause the hair 28 to move along the edges 40 in the direction of the base 38, the hair being slightly pulled out of the skin 27. In the situation shown in FIGS. 11 and 12 the cutting edge 24 of the cutting element 22 has reached the hair 28 at the location B and the hair is cut at this location by the cooperation of the cutting element 22 and the shear plate 3. Hairs which are subsequently caught between the adjacent teeth 35 push the cut-off portion of the hair 28 into the widened portion 39, where the cut-off hair portion is no longer retained by the edges 40 and can drop out of the cutting unit.

Thus, a portion of the hair 28 is cut which is longer by an amount corresponding to the distance between A and B than the portion which would be cut without hair-pulling elements, yielding a better shaving result.

As is shown in FIG. 10 the contact edges 40 take the form of sharp edges which slightly penetrate the hair. It is alternatively possible to use different contact edges. It is merely of importance that, as the hair slips along the contact edges, the hair is subject to a force having a component which is directed away from the shear plate. The width of the gap 37 should be approximately equal to the average hair thickness, namely, 0.13 mm. It is alternatively possible to make the teeth elastically movable, so that the width of the gap 37 slightly adapts itself to the hair thickness.

The embodiment of FIGS. 13 to 18 concerns a cutting unit 5 also having a central disc 21 provided with the coupling aperture 20 and having cutting elements 22 which are secured to the central disc 21 with the aid of the arms 23. The cutting elements are provided with cutting edges 24. The hair-pulling elements 41 are constituted by projecting portions on the cutting elements, which projecting portions have sharp contact edges 42.

Figure 14:
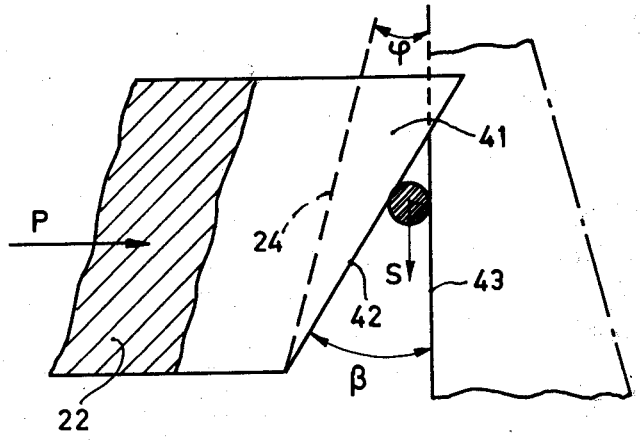
FIGS. 14 to 18 show details on a further enlarged scale of the embodiment of FIG. 13.

In this embodiment the cutting edge of the cutting element cooperates with the elongate facing edge of a hair entry aperture during cutting of a hair. The projection of the sharp edge 42 on the shear plate 3 encloses an acute angle $\beta$ with the elongate edge 43 (FIG. 14). The sharp edge 42 of the hair-pulling element 41 tapers away from the shear plate from a leading point in the direction of driving to a trailing point in the direction of driving (FIG. 15).

The hair entry aperture 4 for example has an elongate shape, so that the edge 43 of the hair entry aperture which cooperates with the cutting edge 24 during cutting of a hair has a straight shape.

Figure 13:
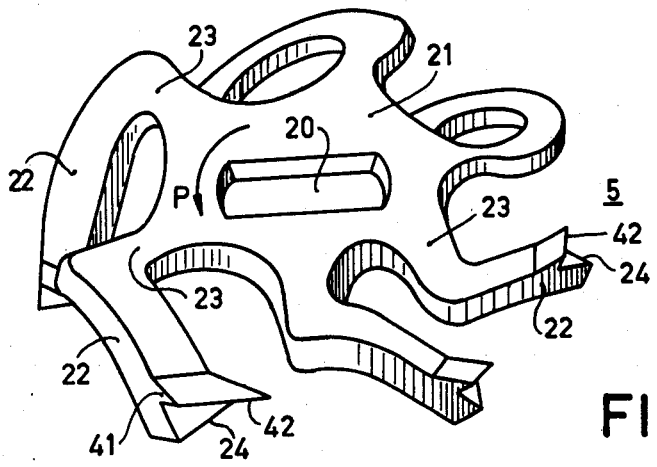
FIG. 13 is a perspective view on an enlarged scale of still another embodiment of the cutting unit.
Figure 16:
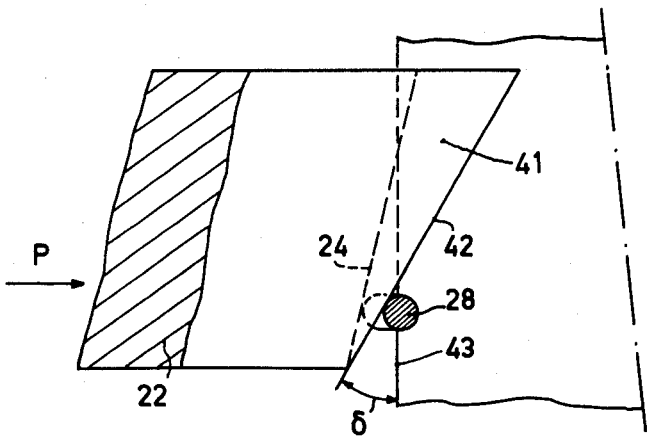
Figure 17:
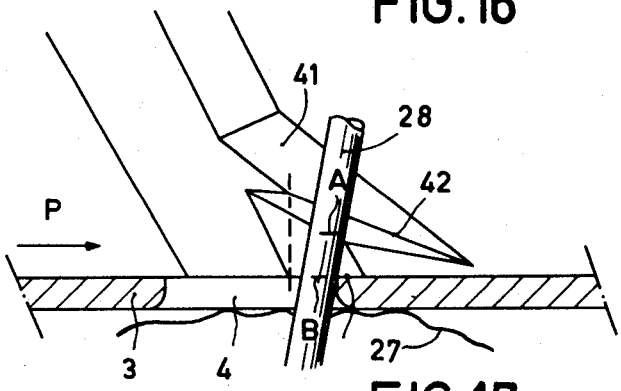
Figure 18:
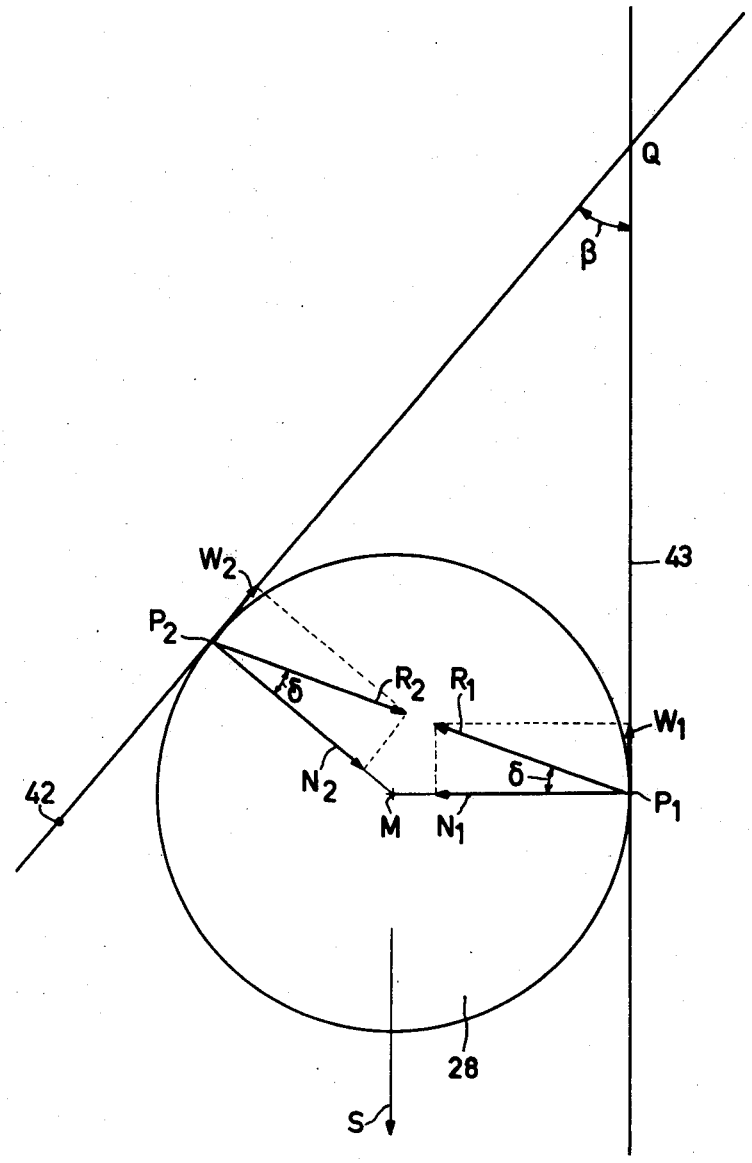

The operation of this embodiment which is shown in perspective in FIG. 13 will now be described with reference to FIGS. 14 to 18. FIGS. 15 and 17 schematically show a side view of a part of the cutting unit 5 and the shear plate 3, whilst moreover a part of the skin 27 to be shaved with a hair 28 is shown. FIGS. 14 and 16 are plan views of the details in accordance with FIGS. 15 and 17 respectively. FIG. 18 on an enlarged scale shows a detail of FIG. 14 and the forces acting on the hair.

Figure 15:
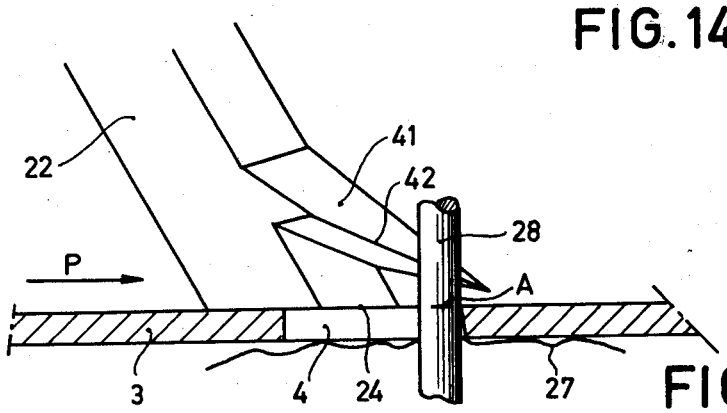

FIGS. 14 and 15 represent the instant at which the hair 28 has just come into contact with the sharp edge 42 of the hair-pulling element 41. The hair 28 contacts the elongate edge 43 of the hair entry aperture 4 on the opposite side. It has been found that if the angle $\beta$ (FIG. 14) is selected greater than twice the friction angle, the hair 28 is pushed away in the direction S. This is explained with the aid of FIG. 18, which only shows the sharp edge 42 and the edge 43 with the hair 28 between them. The edge 43 exerts the force $N_1$, which is directed perpendicularly to the edge 43, and the friction force $W_1$ on the hair 28 at point $P_1$. These two forces result in the force $R_1$. The sharp edge 42 exerts corresponding forces $N_2$ and $W_2$, resulting in force $R_2$, on the hair at point $P_2$. For the sake of simplicity the hair 28 is assumed to be of circular cross-section with a centre M. Furthermore it is assumed that the situation is just balanced, so that $R_1$ and $R_2$ are in line, are opposed and are of equal magnitude.

In the quadrangle formed by M, $P_1$, $P_2$ and the intersection Q of the sharp edge 42 and the edge 43, $QP_1$ is equal to $QP_2$ and $P_1M$ is equal to $P_2M$. It is evident that furthermore $\beta=2\delta$, $\delta$ being the friction angle between $N_1$ and $R_1$ and between $N_2$ and $R_2$ respectively. If the angle $\delta$ is greater than this value, the hair 28 will move in the direction S. In practice it has been found that this effect is already obtained at values of $\delta$ between 10° and 20°.

The sharpness of the sharp edge 42 is such that this edge will slightly penetrate the hair 28, but will not cut the hair. During the movement in the direction S the hair 28 will slip along the sharp edge 42 and come into contact with parts of the sharp edge which are more remote from the shear plate 3, so that the hair will be pulled slightly out of the skin 27. Eventually, the cutting edge 24 of the cutting element 22 reaches the hair 28 (FIGS. 16 and 17) at the location B and the hair is cut by cooperation of the cutting element and the shear plate at this location. Without the hair-pulling element the hair would be cut at the location A (FIGS. 15 and 17), so that a better shaving result is obtained.

The hair-pulling elements 41 may again be combined with a central body to form a separate hair-pulling member, which may be secured to a cutting member.

The hair-pulling elements 41 may also be integral with the cutting elements 22. The complete cutting unit 5 is then for example manufactured from a sintered material.

Figure 19:
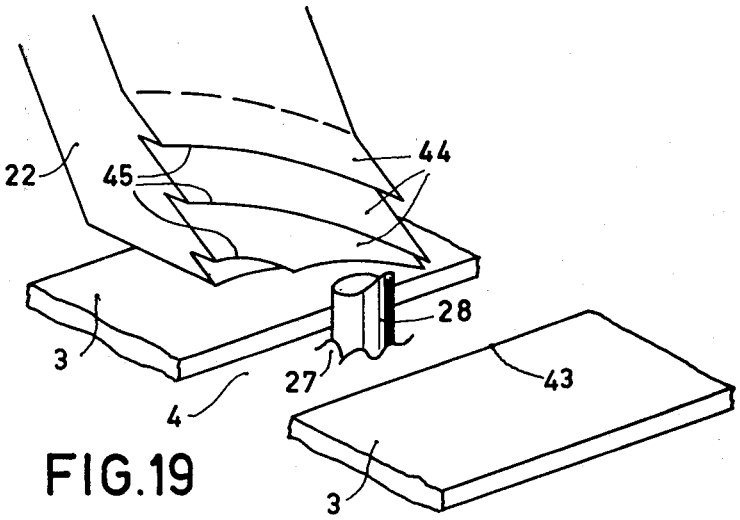
FIG. 19 shows a detail on a further enlarged scale of a variant of the embodiment of FIG. 13 in perspective.

The embodiment shown in perspective in FIG. 19 has a cutting element 22, comprising a plurality of hair-pulling elements 44, whose sharp edges 45 do not extend in accordance with a straight line but have a curved shape. Further, the operation is similar to that of the embodiment of FIG. 13. The advantage of an embodiment with a plurality of hair-pulling elements per cutting element is that the hair-pulling elements which are situated further from the shear plate 3 can take over the function of the hair-pulling elements which are disposed nearer the shear plate, if the last-mentioned elements together with a part of the cutting element should become worn.

The hair-pulling elements in accordance with the invention may also be employed in shaving apparatus other than those of the rotary type, such as for example vibratory shaving apparatus.

The embodiments described above, with a hair-pulling element which is immobile or fixed relative to the cutting element, generally have the advantage that they can be manufactured simply and the operation is less soon affected by soiling. The risk of damaging of the cutting unit upon contact with other objects is reduced in comparison with the embodiments having a hair-pulling element which is movable relative to the associated cutting element, so that the cutting unit may be removed from the shaving apparatus, as the case may be, cleaned, and be refitted in a simpler manner.

We claim:

1. A shaving apparatus having a shear plate provided with hair entry apertures and a cutting unit associated with and drivable relative to the shear plate; said cutting unit comprising a cutting member, cutting elements extending from said cutting member toward the shear plate, each cutting element being formed with a cutting edge, and hair-pulling elements respectively associated with the cutting elements and positioned in front of said cutting elements in the direction of driving, each hair-pulling element being immobile relative to the associated cutting element and being formed with a hair-contact edge, said hair-contact edge being located at a greater distance from the shear plate than said cutting edge.

2. A shaving apparatus according to claim 1, in which each hair-pulling element constitutes an integral portion of its associated cutting element.

3. A shaving apparatus according to claim 2, in which each hair entry aperture has an elongate edge, and in which the projection of the hair-contact edge of each hair-pulling element on the shear plate encloses an acute angle with the elongate edge of each hair-entry aperture, said acute angle being greater than the friction angle, the hair-contact edge of each hair-pulling element tapering up and away from the shear plate from a point of the hair-contact edge in front of the associated cutting element in the direction of driving to a point of the hair-contact edge trailing the associated cutting element in the direction of driving.

4. A shaving apparatus according to claim 3, in which the magnitude of the angle between the projection of the hair-contact edge of each hair-pulling element and the elongate edge of each hair entry aperture varies continuously during operation.

5. A shaving apparatus according to claim 2 or 3, in which each cutting element is provided with a plurality of hair-pulling elements.

6. A shaving apparatus according to claim 1, in which the cutting unit includes a separate central body, the hair-pulling elements extending from said central body.

7. A shaving apparatus according to claim 6, in which the cutting elements are integrally formed with the cutting member, and in which the hair-pulling elements are integrally formed with the control body to provide a hair-pulling member, the cutting member and the hair-pulling member being secured to each other.

8. A shaving apparatus according to claim 1, in which each hair-pulling element is provided with spaced teeth disposed at an acute angle relative to the shear plate, the hair-contact edge being provided on both sides of each tooth.

9. A shaving apparatus according to claim 8, in which the space between two adjacent teeth has a widened portion near the base of the teeth.

* * * * *